US005111781A

United States Patent [19]

Kaku et al.

[11] Patent Number: 5,111,781

[45] Date of Patent: May 12, 1992

[54] VALVE ACTUATING MECHANISM IN FOUR-STROKE CYCLE ENGINE

[75] Inventors: Shinji Kaku, Higashiwakabayashi; Tatsuya Shinkai, Hamamatsu, both of Japan

[73] Assignee: Suzuki Kabushiki Kaisha, Takatsuka, Japan

[21] Appl. No.: 667,981

[22] Filed: Mar. 12, 1991

[30] Foreign Application Priority Data

Mar. 14, 1990 [JP] Japan ..... 2-24892[U]
Mar. 20, 1990 [JP] Japan ..... 2-27683[U]
Mar. 20, 1990 [JP] Japan ..... 2-68276

[51] Int. Cl.[5] ..... F01L 1/34
[52] U.S. Cl. ..... 123/90.16; 123/90.15
[58] Field of Search ..... 123/90.15, 90.16, 90.17

[56] References Cited

U.S. PATENT DOCUMENTS

| | | | |
|---|---|---|---|
| 4,397,270 | 8/1983 | Aoyama | 123/90.16 |
| 4,638,773 | 1/1987 | Bonvallet | 123/90.16 |
| 4,643,141 | 2/1987 | Bledsoe | 123/90.16 |
| 5,018,487 | 5/1991 | Shinkai | 123/90.16 |
| 5,025,761 | 6/1991 | Chen | 123/90.16 |

FOREIGN PATENT DOCUMENTS

| | | | |
|---|---|---|---|
| 148910 | 11/1980 | Japan | 123/90.16 |
| 193705 | 11/1982 | Japan | 123/90.17 |

OTHER PUBLICATIONS

Japanese Utility Model Publication No. 55-152308, 1980 (no month provided).

*Primary Examiner*—Raymond A. Nelli
*Assistant Examiner*—Weilun Lo
*Attorney, Agent, or Firm*—Schwartz & Weinrieb

[57] ABSTRACT

A valve actuating mechanism disposed in a four-stroke cycle engine within which exhaust and intake valves are disposed, comprises a rocker shaft rotatably supported upon a cylinder head of an engine unit and having eccentric large-diameter portions formed as bushings upon the rocker shaft, rocker arms including a first rocker arm rotatably mounted directly upon the rocker shaft and second and third rocker arms rotatably mounted upon the bushings with the first rocker arm being interposed therebetween, and a cam assembly including first, second and third cam members which drives the first, second and third rocker arms, respectively. The second and third cams have the same cam profiles and the first cam has a cam profile different from those of the second and third cams. A driving mechanism for rotating the rocker shaft is connected to one end of the rocker shaft and comprises a hydraulic cylinder, a rack connected thereto and a pinion formed upon the one end of the rocker shaft so as to be engaged with the rack from the upper side of the cylinder head. A stopper mechanism for controlling the rotational and sliding position of the rocker shaft is composed of a stopper hole formed within the cylinder head, a stopper screw engaged with the stopper hole and a stopper member disposed upon the other end portion of the rocker shaft.

25 Claims, 9 Drawing Sheets

VALVE ACTUATING MECHANISM IN FOUR-STROKE CYCLE ENGINE

FIELD OF THE INVENTION

This invention relates to a valve actuating mechanism disposed within a four-stroke cycle engine which is capable of varying the lift and timing of the opening operating of the intake and exhaust valves in accordance with the operation conditions of the engine, and more particularly, relates to a valve actuating mechanism in which the changing of a shim provided within the vicinity of the valve stem head may be effectively performed, abrasion of the rocker shaft bearing supporting the rocker shaft which is formed in accordance with the cylinder head of the engine can be effectively prevented, and the arrangement of the driving source for the rocker shaft is improved.

BACKGROUND OF THE INVENTION

Usually, a four-stroke cycle engine to be mounted upon a vehicle such as an automobile and a motorcycle is provided with intake and exhaust valves at a position above its combustion chamber and these valves are driven by means of a valve actuating mechanism. Specifically, the valve actuating mechanism is provided with a crank shaft of the engine so that the intake and exhaust valves are caused to move in an up and down reciprocating mode in accordance with a predetermined timing operation by means of a cam which is formed upon a cam shaft.

It is desirable in connection with a four-stroke cycle engine that a high output may be obtained throughout a broad speed range extending from a low speed region to an intermediate-high speed region, that is, that the power band is wide.

However, in a conventional valve actuating mechanism, since the timing for opening or closing a valve and the amount of lift are fixed, only an output characteristic having a peak value within a specific engine speed region may be obtained and one is therefore forced to make a choice as to whether the output characteristic in the low speed region is to be emphasized or the output characteristic in the intermediate-high speed region is to be emphasized.

OBJECTS OF THE INVENTION

An object of this invention is to substantially eliminate the defects or drawbacks encountered in the prior art and to provide a valve actuating mechanism for a four-stroke cycle engine which is capable of improving the output throughout a broad speed range and wherein a shim provided within the vicinity of the valve stem head for adjusting the tappet clearance may be effectively changed.

Another object of this invention is to provide a valve actuating mechanism for a four-stroke cycle engine in which a rocker shaft driving source is easily assembled.

A further object of this invention is to provide a valve actuating mechanism for a four-stroke cycle engine in which abrasion of a rocker shaft bearing disposed within the cylinder head for supporting the rocker shaft can be prevented.

SUMMARY OF THE INVENTION

These and other objects can be achieved according to this invention by providing a valve actuating mechanism within a four-stroke cycle engine in which exhaust and intake valves are disposed, wherein the invention comprises a rocker shaft rotatably supported upon the cylinder head of an engine unit and having eccentric large-diameter portions formed as bushings upon the rocker shaft, rocker arms including a first rocker arm rotatably mounted directly upon the rocker shaft and second and third rocker arms rotatably mounted upon the bushings with the first rocker arm being interposed therebetween, and a cam assembly including first, second and third cam members which drives the first, second and third rocker arms, respectively. The second and third cams have the same cam profiles and the first cam has a cam profile which is different from those of the second and third cams. A driving mechanism for rotating the rocker shaft is connected to one end of the rocker shaft and comprises a hydraulic cylinder, a rack connected thereto and a pinion formed upon the one end of the rocker shaft so as to be engaged with the rack from the upper side of the cylinder head. A stopper mechanism for controlling the sliding position or movement of the rocker shaft is further provided and is composed of a stopper groove formed within the cylinder head, a stopper screw engaged with the stopper groove and a stopper member disposed upon the other end portion of the rocker shaft.

The stopper member is composed of grooves formed upon the outer periphery of the one end of the rocker shaft and includes a positioning groove extending in a circumferential direction thereof into which a front portion of the stopper screw is fitted for limiting the rotating position of the rocker shaft, and a slide groove being formed continuously with the positioning groove and extending in an axial direction of the rocker shaft in and along which the rocker shaft is slid. A slide hold groove is further formed continuously with the slide groove in the circumferential direction of the rocker shaft for maintaining the slid position thereof.

With the valve actuating mechanism for a four-stroke cycle engine according to this invention and of the character described above, the rocker shaft is rotated through means of a predetermined angle in order to rotate the eccentric large-diameter portion so that the cam follower surfaces of the second and third rocker arms are changed in position with respect to the cam follower surface of the first rocker arm. When the cam follower surfaces of the first and third rocker arms are changed in a downward mode with respect to the cam follower surface of the first rocker arm, the contacts defined between the second and third rocker arms and the second and third cams are released so as to bring the first rocker arm and the first cam into contact with each other so that an intake or exhaust valve of the four-stroke cycle engine is driven by means of this first cam.

On the other hand, when the cam follower surfaces of the second and third rocker arms are changed in a generally upward mode or to the same level with respect to the cam follower surface of the first rocker arm, the contact between the first rocker arm and the first cam is released so that the second and third rocker arms and the second and third cams are respectively brought into contact whereby the valve of the four-stroke cycle engine is able to be operated by means of the second and third cams. In this way, it is possible to improve the output of the engine for a broad speed range by selecting a cam through means of the rotation of the rocker shaft.

Furthermore, a slide hold groove is formed upon the rocker shaft as a continuation of a slide groove and the distal end portion of a stopper screw is accommodated within this slide hold groove so that the slid position of the rocker shaft is retained. Therefore, when the rocker shaft is slid so as to move the first, second and third rocker arms in order to change a shim within the vicinity of the valve stem head, since there is no need for the operator to hold the slid rocker arm by means of his hand or the like, the work for changing the shim may be facilitated so as to improve the efficiency in changing the shim.

Furthermore, since the rack is engaged with the pinion of the rocker shaft from the upper side of the cylinder head, the rack and the rocker shaft driving mechanism can be easily assembled along with the cylinder head after the rocker arms, the rocker shaft and the vales are assembled with the cylinder head without sliding the rocker shaft.

Moreover, since the rocker shaft driving mechanism and the stopper mechanism for positioning the rocker shaft rotating position are disposed upon both end portions of the rocker shaft, torsion is applied during the engine operation to substantially the entire axial length of the rocker shaft. Accordingly, the rocker shaft is never swung even if the rocker arms are violently moved vertically, whereby the abrasion of the rocker shaft bearing portion can be effectively prevented.

BRIEF DESCRIPTION OF THE DRAWINGS

For a better understanding of this invention and to show how the same is carried out, reference is first made, by way of the preferred embodiment, to the accompanying drawings, in which like reference characters designate like or corresponding parts throughout the several views, and wherein.

DESCRIPTION OF THE PREFERRED EMBODIMENTS

An embodiment of this invention will now be described hereunder with reference to the drawings.

Figure 1:
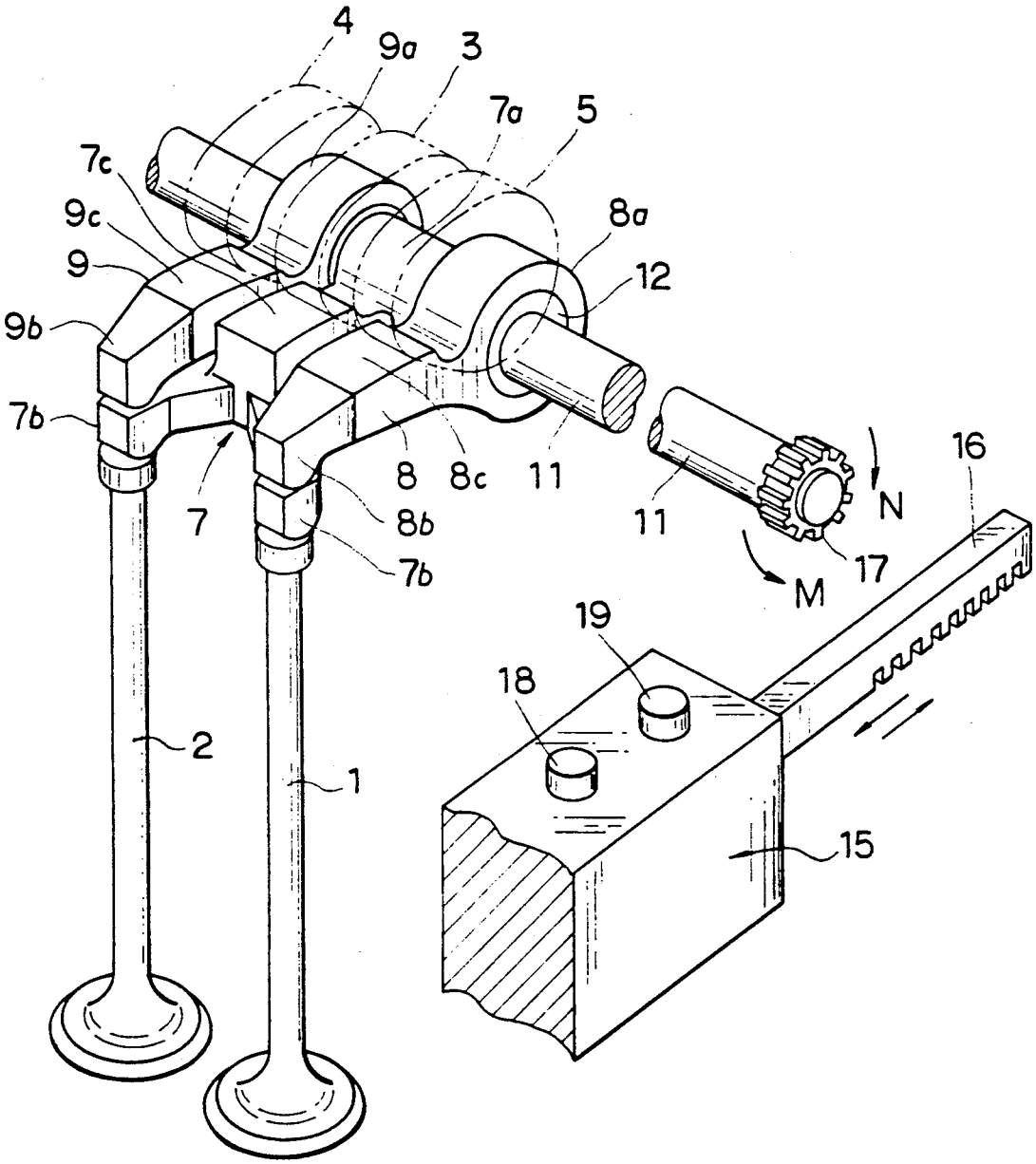
FIG. 1 is a perspective view showing one embodiment of a valve actuating mechanism disposed within a four-stroke cycle engine according to this invention.
Figure 2:
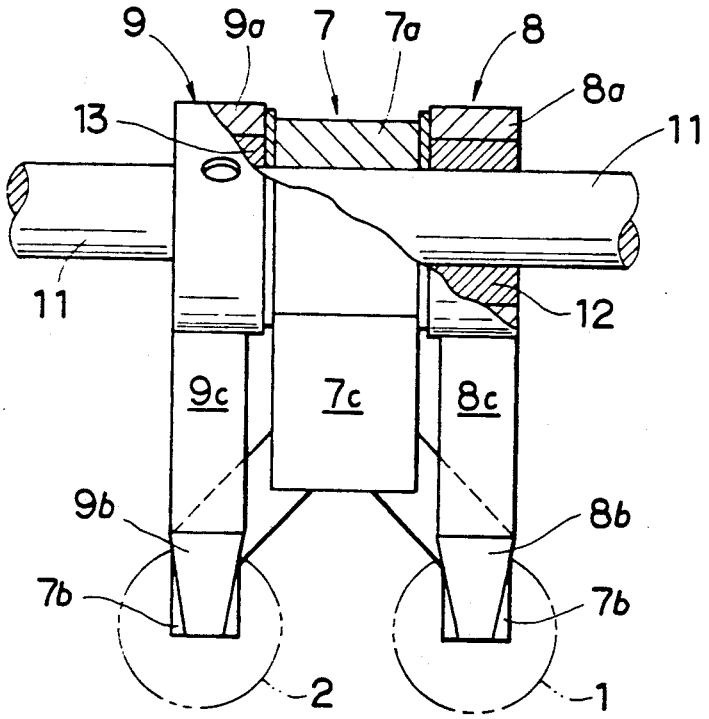
FIG. 2 is a plan view of the valve actuating mechanism of FIG. 1.

A valve actuating mechanism according to this invention is arranged both at the intake side and at the exhaust side of each cylinder of a four-stroke cycle engine. Accordingly, intake and exhaust valves 1 and 2 as shown in FIG. 1 are arranged to perform intake and exhaust functions or operations.

Referring to FIGS. 1 to 4, the embodiment of this invention comprises a cam shaft 6 having a low speed cam 3 as a first cam as well as an intermediate-high speed cam 4 provided as a second cam and another intermediate-high speed cam 5 provided as a third cam which are arranged respectively upon opposite sides of the low speed cam 3, a low speed rocker arm 7 as a first rocker arm, an intermediate-high speed rocker arm 8 as a second rocker arm and another intermediate-high speed rocker arm 9 as a third rocker arm which are provided below the cams 3, 4 and 5, respectively, and a rocker shaft 11 supported in a rotatable manner by means of a rocker shaft bearing portion 30 (FIG. 5) to be described later and fitted with supporting portions **7*a*, 8*a* and 9*a* of the rocker arms 7, 8 and 9**.

The distal end of the low speed rocker arm 7 is branched into two parts, and the two branched ends **7*b* are in contact with the stem heads of the intake and exhaust valves 1 and 2, respectively, which open or close a combustion chamber 27 (FIG. 7) of an engine. Furthermore, the supporting portion 7*a* of the low speed rocker arm 7 is directly mounted upon the rocker shaft 11** in a rotatable manner.

Figure 3:
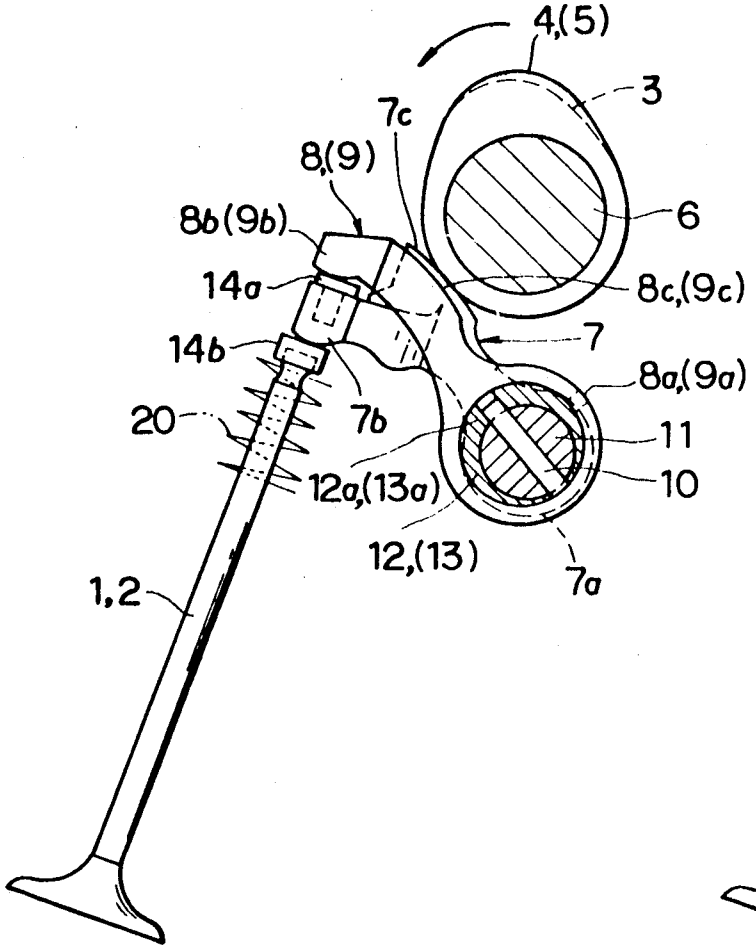

The supporting portion **8*a* of the intermediate-high speed rocker arm 8 is mounted in a rotatable manner with respect to the rocker shaft 11 by means of an eccentric bushing 12 which has a diameter larger than that of the rocker shaft 11. As shown in FIG. 3, the axis of the eccentric bushing 12 is eccentric with respect to the center of the rocker shaft 11 and is fixed upon the rocker shaft 11 in a dismountable and reattachable manner by means of a stopper pin 10. Therefore, this eccentric bushing 12 serves as the eccentric large-diameter portion of the rocker shaft 11**.

Figure 4:
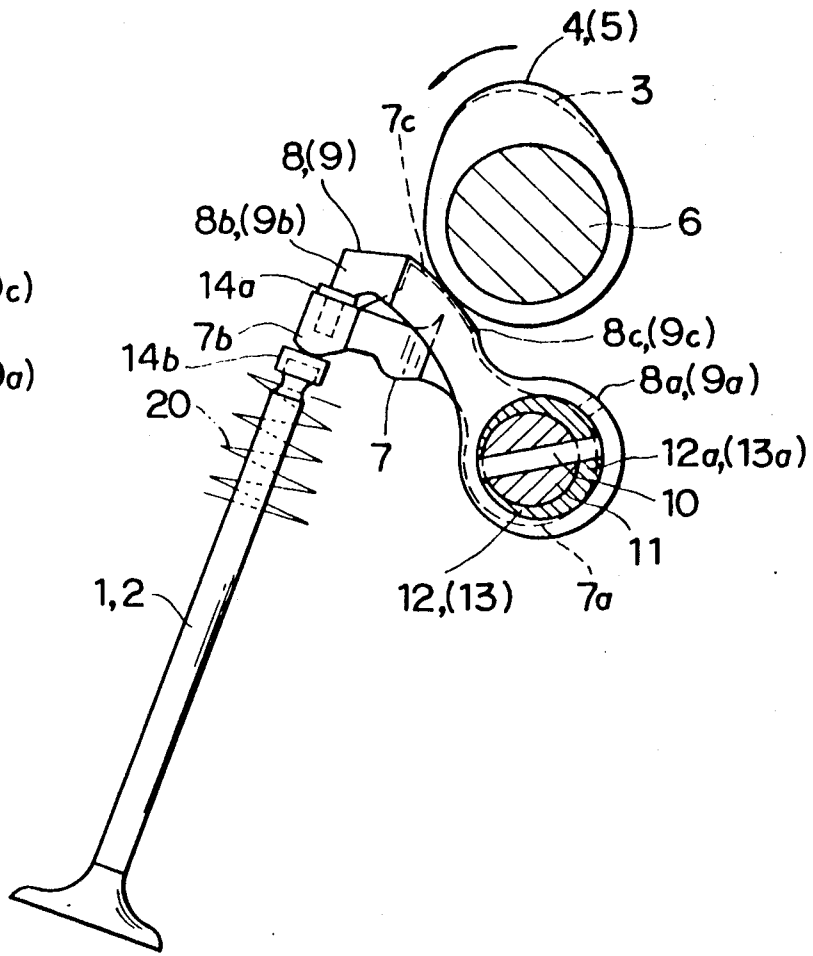
FIGS. 3 and 4 are views each showing the valve actuating mechanism of FIG. 1 in connection with the operational state thereof.

As shown in FIG. 4, the supporting portion **9*a* of the intermediate-high speed rocker arm 9 is also fitted in a rotatable manner with respect to the rocker shaft 11 by means of an eccentric bushing 13 which has an identical configuration and is eccentric in the same direction as the above described eccentric bushing 12. This eccentric bushing 13 is also fitted upon the rocker shaft 11 in a dismountable and reattachable manner by means of a stopper pin 10 and serves as the eccentric large-diameter portion of the rocker shaft 11**.

Furthermore, the lower surfaces of the distal end portions **8*b* and 9*b* of the intermediate-high speed rocker arms 8 and 9 are caused to abut against the branched distal end portions 7*b*, respectively, of the low speed rocker arm 7 by means of a shim 14*a*. The points of contact defined between the branched portions 7*b* of the low speed rocker arm 7 and the distal end portions 8*b* and 9*b* of the intermediate-high speed rocker arms 8 and 9 are substantially located along the longitudinal axes of the valves 1 and 2**, respectively.

Figure 7:
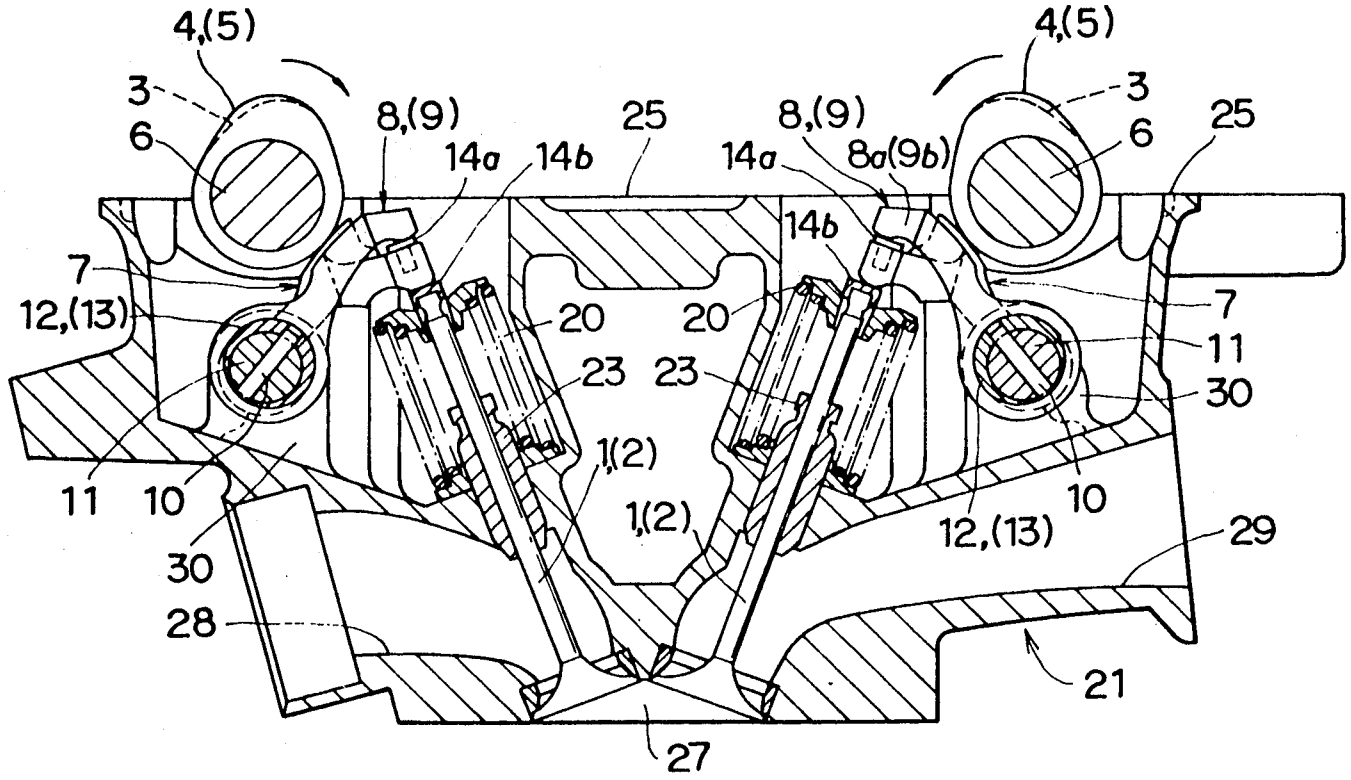
FIG. 7 is a sectional view taken along the line 7—7 shown in FIG. 6.

Accordingly, as shown in FIG. 3 and FIG. 7, when the cam follower surface of the low speed rocker arm 7 is pushed downwardly by means of the low speed cam 3 so as to lower the distal end portions **7*b* of the low speed rocker arm 7, the distal end portions 8*b* and 9*b* of the rocker arms 8 and 9 are caused to descend under the influence of gravity so as to follow the branched distal end portions 7*b* of the low speed rocker arm 7. On the other hand, as shown in FIG. 4, when the cam follower surfaces 8*c* and 9*c* of the intermediate-high speed rocker arms 8 and 9 are pushed downwardly by means of the intermediate-high speed cams 4 and 5, respectively, the distal end portions 8b and 9b of the rocker arms 8 and 9 push the distal end portions 7b of the low speed rocker arm 7 downwardly so that the distal end portions 7b of the low speed rocker arm 7** are forced to descend.

The above described shim 14a is one having a T-shaped longitudinal section and is fitted from the top into both branched end portions 7b of the low speed rocker arm 7. The valve stem heads of the valves 1 and 2 are each covered by means of a cylindrical shim 14b having a lid, and the lower surface of each distal end portion 7b of the low speed rocker arm 7 abuts against the shim 14b. These shims 14a and 14b are used for adjusting the tappet clearance of the valves 1 and 2.

Furthermore, the intermediate-high speed cams 4 and 5 have the same cam profile with respect to the each other, and the low speed cam 3 has a cam profile that is different from the cam profile of the intermediate-high speed cams 4 and 5. In other words, in connection with the low speed cam 3, a cam profile is provided so as to obtain a valve lift and timing of the opening or closing of the valve which are suitable when the engine is operated within the low speed range. Furthermore, with respect to the intermediate-high speed cams 4 and 5, a cam profile is provided so as to obtain a valve lift and timing of the opening or closing of the valve which are suitable when the engine is operated in the intermediate-high speed range.

Figure 10:
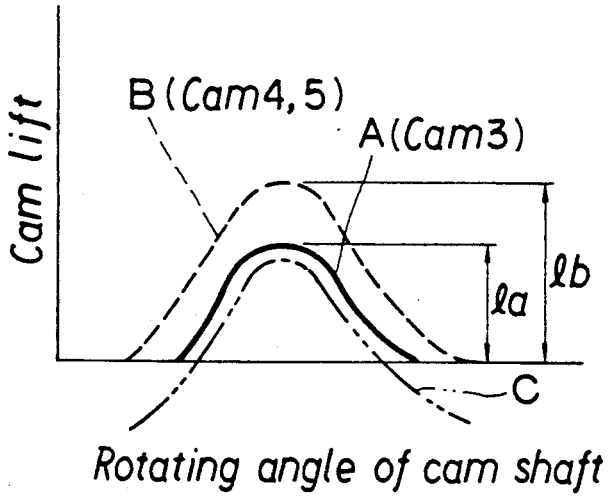
FIG. 10 is a diagram showing the cam profile of the cam shown in FIG. 1.

The valve lifts as described above correspond to the stroke length of the valves 1 and 2 as determined by means of the cam profiles and coincide with the rocker arm and cam lifts. In FIG. 10, the cam profile of the low speed cam 3 is indicated by means of the solid line A (cam lift 1a) while the cam profile of the intermediate-high speed cams 4 and 5 is indicated by means of the dashed line B (cam lift 1b). As can be seen from FIG. 10. the cam profile of the intermediate-high speed cams 4 and 5 is provided so as to obtain a valve lift which is larger than that of the low speed cam.

In FIG. 10, the two-dot chain line C indicates the cam profile of the intermediate-high speed cams 4 and 5 when the rocker shaft 11 is rotated so as to locate the thick walled portions 12a and 13a of the eccentric bushings 12 and 13 at diagonally forward positions (FIG. 3 and FIG. 7).

Figure 5:
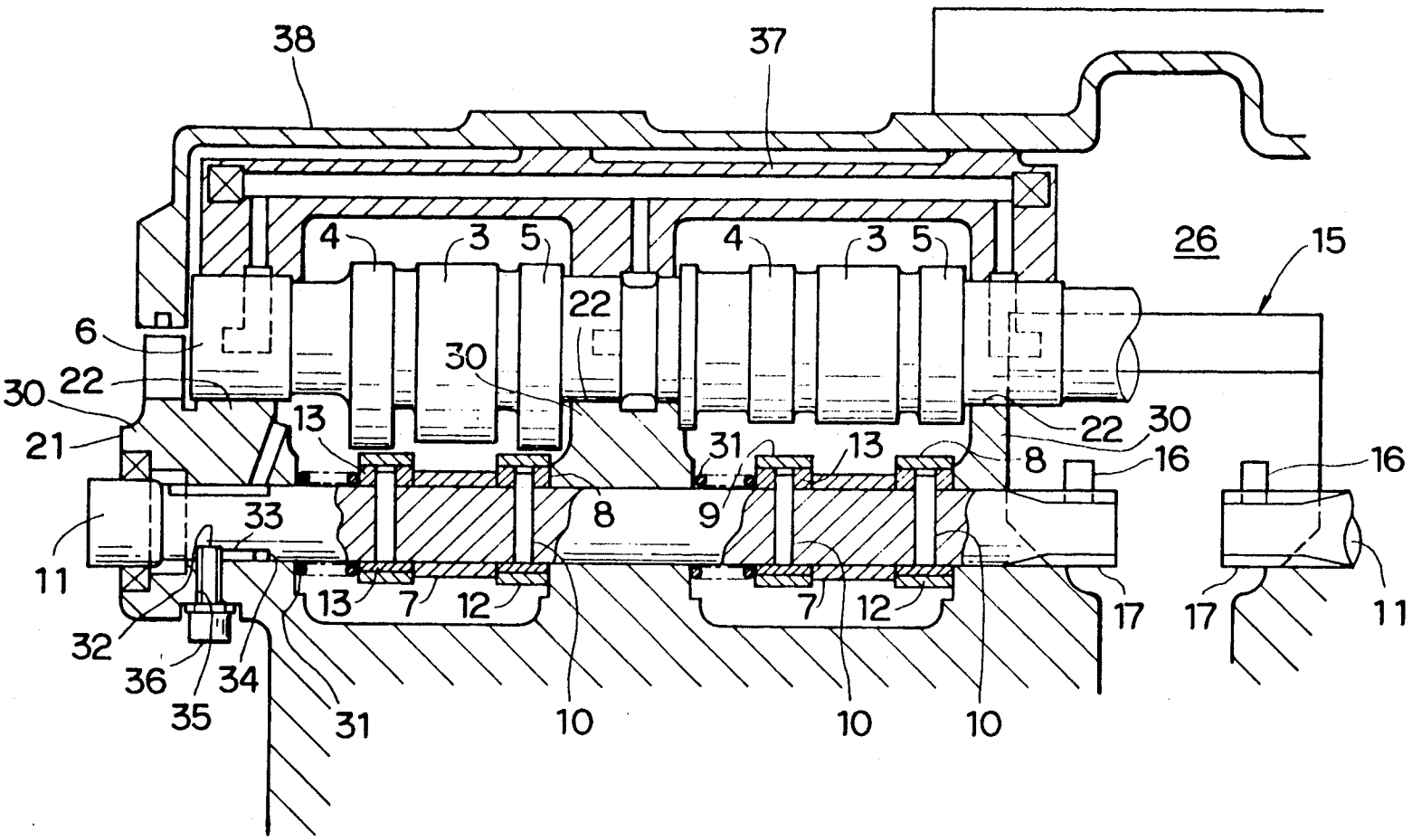
FIG. 5 is a sectional view taken along the line 5—5 shown in FIG. 6.
Figure 6:
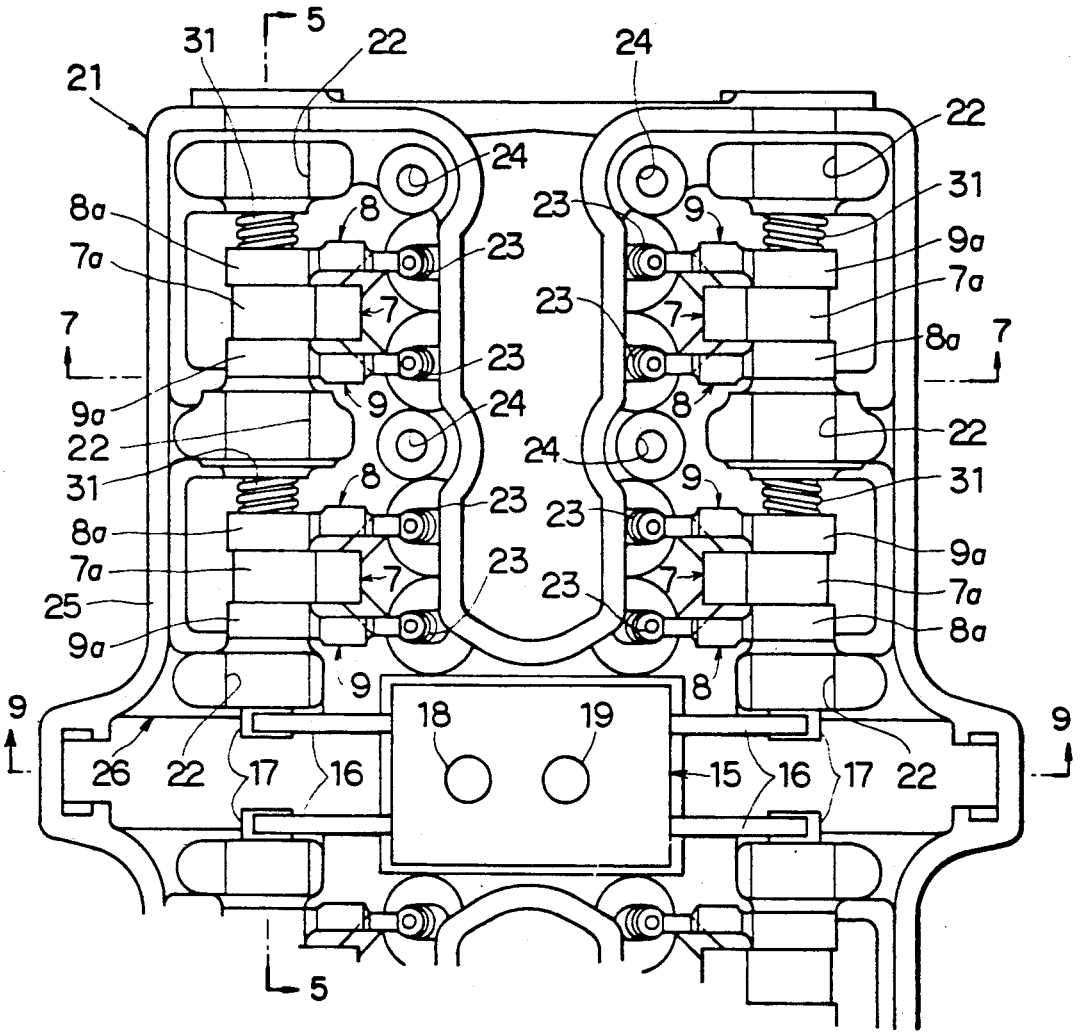
FIG. 6 is a partial plan view of a cylinder head to which the valve actuating mechanism is applied.

As shown in FIGS. 1, 5 and 6, the rotation of the rocker shaft 11 is caused by means of a hydraulic cylinder 15 which is actuated by means of oil pressure from the engine. A piston of this hydraulic cylinder 15 is coupled to a rack 16, and the rack 16 is meshed with a pinion 17 which is formed upon one end portion of the rocker shaft 11. A drive mechanism is therefore constituted by means of the hydraulic cylinder 15, rack 16 and pinion 17. A low-speed oil pressure port 18 and a high-speed oil pressure port 19 are provided upon the hydraulic cylinder 15, respectively, and the oil pressure from the engine is selectively introduced into each of the ports 18 and 19.

When the speed of the engine is within the low speed range, the oil pressure is supplied to the low-speed oil pressure port 18, thereby retracting the rack 16 so as to cause the pinion 17 to rotate in the direction of the arrow M so that as shown in FIG. 3 and FIG. 7 the eccentric bushings 12 and 13 are rotated so as to locate their thick walled portions 12a and 13a at diagonally forward positions. Furthermore, when the engine speed is within the intermediate-high speed range, the oil pressure is supplied to the intermediate-high speed oil pressure port 19, thereby extending the rack 16 so as to cause the pinion 17 to rotate in the direction of the arrow N so that as shown in FIG. 4 the eccentric bushings 12 and 13 are rotated so as to locate their thick walled portions 12a and 13a at diagonally rearward positions.

In this way, the rocker shaft 11 is constructed such that the thick walled portions 12a and 13a of the eccentric bushings 12 and 13 are rotated within the range extending from a diagonally forward position to a diagonally rearward position at all times, with respect to the upper half of the rocker shaft 11 by means of the action of the hydraulic cylinder, rack, and pinion 15, 16 and 17, respectively.

The rocker shaft 11, the hydraulic cylinder 15, the rack 16 and the pinion 17 as described above are arranged within a cylinder head 21 as shown in FIGS. 5 to 7. A total of four rocker shafts 11 are arranged within the cylinder head 21 and are placed toward front and rear and left and right locations of the vehicle and are extended in left and right directions with respect to the vehicle. Each of the rocker shafts 11 is supported in a rotatable manner by means of a rocker shaft bearing portion 30. A lower half bearing part 22 for supporting the cam shaft 6 is formed above each of the rocker shafts 11.

Within the lower half bearing part 22, a plurality of valve guides 23 (FIG. 6 and FIG. 7) are arranged and a plurality of stud bolt holes 24 are formed therein. Furthermore, a joint surface 25 to be attached to a head cover is formed along the upper portion of the cylinder head 21 while a cam chain chamber 26 is formed within the cylinder head 21 at the center thereof so as to extend in a left and right direction of the vehicle. The hydraulic cylinder 15 and rack 16 are positioned within the cam chain chamber 26.

Furthermore, as shown in FIG. 7, a combustion chamber 27 is formed within the lower portion of the cylinder head 21, and a suction or intake port 28 and an exhaust port 29 are formed in communication with this combustion chamber 27. The valve faces of the valves 1 and 2 are positioned upon the boundaries which partially define the upper extent of the combustion chamber 27 and are disposed at inner ends of intake port 28 and the exhaust port 29. The intake port 28 and exhaust port 29 are opened or closed by means of the valves 1 and 2 under the influence of the action of a valve spring 20 as well as the low speed rocker arm 7 and the intermediate-high speed rocker arms 8 and 9.

As shown in FIG. 6, the two sets, each consisting of a low speed rocker arm 7 and the intermediate-high speed rocker arms 8 and 9, are mounted upon a single rocker shaft 11. The low speed rocker arm 7 and the intermediate-high speed rocker arms 8 and 9 of each set are restricted in position together with the rocker shaft 11 by means of a positioning spring 31 which is placed upon the rocker shaft 11. In other words, the low speed rocker arm 7 and the intermediate-high speed rocker arms 8 and 9 as well as the rocker shaft 11 are pressed toward the center of the cylinder head 21 by means of the biasing force of the positioning spring 31.

Figure 8A:
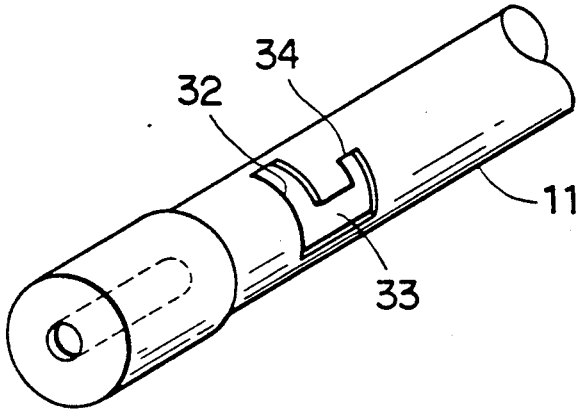
FIGS. 8A and 8B are perspective views each showing one end of a rocker shaft of the valve actuating mechanism.

As shown in FIG. 5 and FIG. 8A, the rocker shaft 11 upon which the pinion 17 is formed at one end portion thereof is provided upon the peripheral surface of the other end portion thereof with a positioning groove 32, a slide groove 33 and a slide hold groove 34 which are continuously formed together in a serial manner. The positioning groove 32 extends in the circumferential direction of the rocker shaft 11 and is formed throughout the angular rotatable range of the rocker shaft 11. Furthermore, the slide groove 33 extends in the axial direction of the rocker arm 11 from one or both of the two ends of the positioning groove 32. In FIG. 8A, a case is shown where the slide groove 33 is extended from one end portion. Furthermore, the slide hold groove 34 is formed so as to extend from the slide groove 33 in the circumferential direction of the rocker shaft 11.

On the other hand, a threaded screw hole 35 is formed within the cylinder head 21 at a position corresponding to the above described positioning groove 32, and a stopper screw 36 is threadedly engaged within the threaded screw hole 35. The distal end of the stopper screw 36 is provided such that it may be accommodated within the positioning groove 32, the slide groove 33 and the slide hold groove 34. When the rocker shaft 11 is rotated by means of the action of the hydraulic cylinder 15, the distal end portion of the stopper screw 36 is caused to abut against each of the two end portions of the positioning groove 32 so as to restrict the rotated position of the rocker shaft 11.

Furthermore, the slide groove 33 and the slide hold groove 34 serve their function when the shim **14*b* mounted upon each stem head of the valves 1 and 2 is changed so as to adjust the tappet clearance. In particular, it is necessary in changing the shim 14*b* to slide the rocker shaft 11 toward the outside of the cylinder head 21 against the biasing force of the positioning spring 31 so as to move the low speed rocker arm 7 and the intermediate-high speed rocker arms 8 and 9 in the same direction. At this time, the distal end portion of the stopper screw 36 is moved into the slide groove 33 so that the slide groove 33 permits relative sliding of the rocker shaft 11. Thereafter, by slightly rotating the rocker shaft 11, the distal end portion of the stopper screw 36 is moved into the slide hold groove 34. As a result, the slide hold groove 34 can hold the slid position of the rocker shaft 11 through means of its engagement with the stopper screw 36**.

In FIG. 5, reference numeral 37 denotes a bearing housing for the cam shaft 6 and numeral 38 denotes a cam shaft housing.

Figure 9:
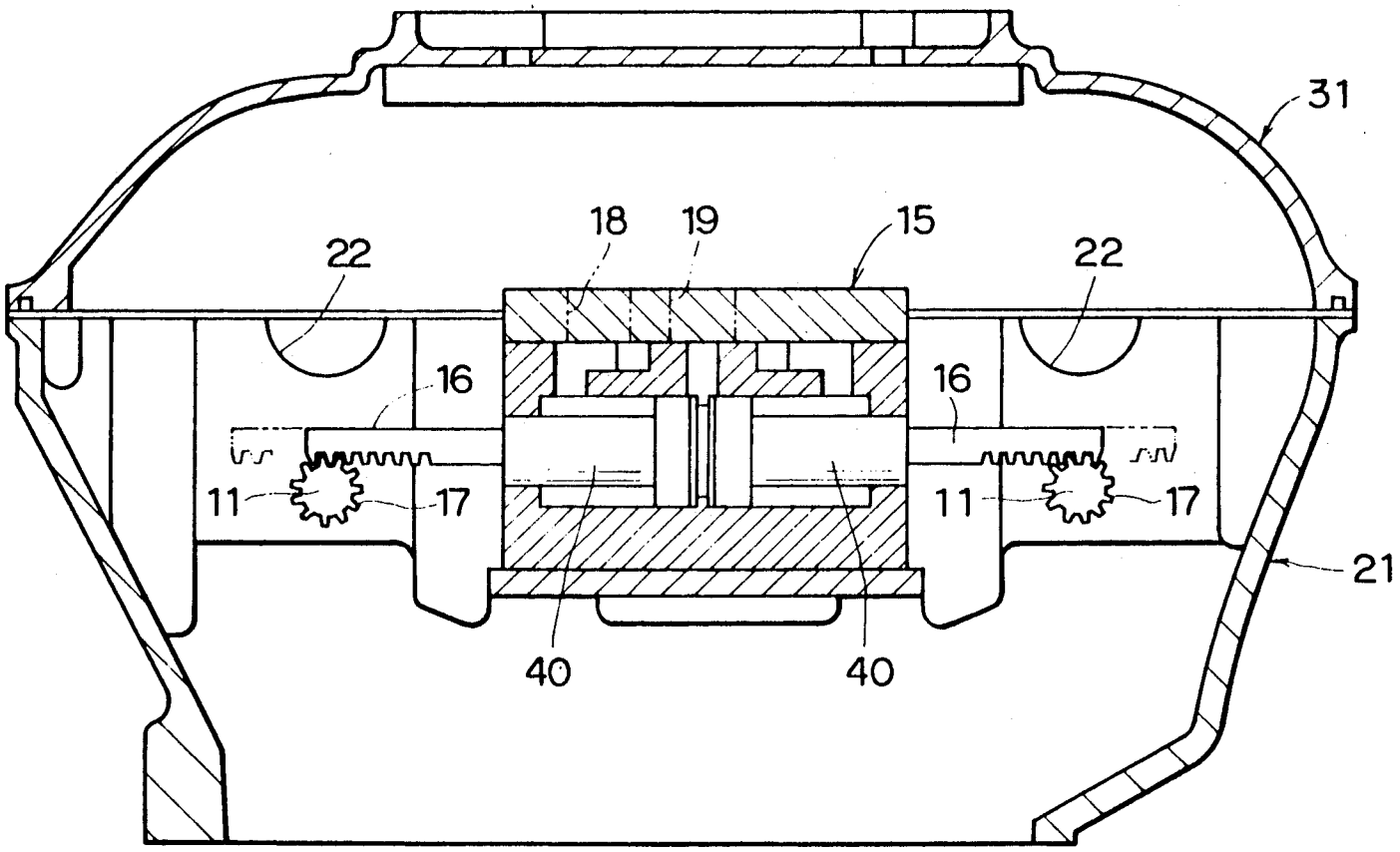
FIG. 9 is a sectional view taken along the line 9—9 of FIG. 6.

Next, referring to FIG. 9, the rotation of the rocker shaft 11 is carried out by means of the actuation of the hydraulic cylinder 15 which includes pistons 40. To each of the pistons 40 there is connected the rack 16 which is engaged with the pinion 17 formed upon one end of the rocker shaft 11 as shown in FIG. 1. The hydraulic cylinder 15 is provided with hydraulic ports 18 and 19 for the low and high speed operations into which the hydraulic pressure from the engine is selectively supplied. As described before and as shown in FIG. 1 and FIG. 9, the rocker shaft 11 and the hydraulic cylinder 15 are disposed within the cylinder head 21 of the engine. The rocker shaft 11 is supported by means of the rocker shaft bearing portion 30 of the cylinder head 21 so as to be rotatable therein. Above the rocker shafts 11 are formed semi-circular holes 22 for receiving the lower half portions of the cam shafts 6 and near the bearing holes 22 valve guides are formed, as well as stud bolt insertion holes 24 as shown in FIG. 6.

The operation and effect of this invention will now be described.

If the rocker shaft 11 is rotated in the direction of the arrow M as shown in FIG. 1 by means of the actuation of the hydraulic cylinder 15 when the engine is being operated within the low speed range, the thick walled portions **12*a* and 13*a* respectively of the eccentric bushings 12 and 13 are positioned diagonally forwardly (FIG. 3 and FIG. 7). Thus the cam follower surfaces 8*c* and 9*c* of the intermediate-high speed rocker arms 8 and 9 are moved downwardly with respect to the cam follower surface 7*c* of the low speed rocker arm 7. Accordingly, a gap is formed between the peripheral surface of the intermediate-high speed cams 4 and 5 and the cam follower surfaces 8*c* and 9*c* of the intermediate-high speed rocker arms 8 and 9, and as a result the intermediate-high speeds cams 4 and 5** rotate in an idle mode.

Furthermore, since the low speed rocker arm 7 at this time is continuously biased upwardly about the axial center of the rocker shaft 11 by means of the biasing force of a valve spring 20, the cam follower surface **7*c* is brought into contact with the peripheral surface of the low sped cam 3. Therefore, when the cam shaft 6 is rotated, the intake and exhaust valves 1 and 2 are moved in an up and down reciprocating mode based upon or in accordance with the lift characteristic graph A of the low speed cam 3 as shown in FIG. 10. In other words, the valves 1 and 2** open or close the combustion chamber in accordance with a lift characteristics of the valve which is suitable for the low speed range of the engine.

On the other hand, if the rocker shaft 11 is rotated in the direction of the arrow N as shown in FIG. 1 by means of the actuation of the hydraulic cylinder 15 when the engine is being operated in the intermediate-high speed range, the thick walled portions **12*a* and 13*a* respectively of the eccentric bushings 12 and 13 are brought into the diagonally rearward position (FIG. 4). Thus the cam follower surfaces 8*c* and 9*c* of the intermediate-high speed rocker arms 8 and 9 are moved with respect to the cam follower surface 7*c* of the low speed rocker arm 7 to a position generally above that or at the same level as that of the cam follower surface 7*c* of the lower speed rocker arm 7 thereby bringing the cam follower surfaces 8*c* and 9*c* into contact with the peripheral surfaces of the intermediate-high speed cams 4 and 5**, respectively.

Hence, since as shown in FIG. 10 the intermediate-high speed cams 4 and 5 are formed so as to have a cam lift which is larger than that of the low speed cam 3, the low speed cam 3 rotates in an idle mode when the cam shaft 6 is rotated in accordance with the condition as shown in FIG. 4 while the intermediate-high speed cams 4 and 5 drive the valves 1 and 2 in accordance with the lift characteristic curve or graph B in FIG. 10 by means of the intermediate-high speed rocker arms 8 and 9, respectively. As a result, the valves 1 and 2 open or close the combustion chamber in accordance with a valve lift characteristics which are suitable for the intermediate-high speed range of the engine.

In accordance with such operations, when the rocker shaft 11 is rotated by means of the action of the hydraulic cylinder 15, rack 16 and pinion 17, the stopper screw 36 is caused to abut against respective end portions of the positioning groove 32. As a result, the rocker shaft 11 is caused to stop at those positions where the thick walled portions **12*a* and 13*a* of the above described eccentric bushings 12 and 13 are placed at diagonally forward (FIG. 3) or at diagonally rearward (FIG. 4**) locations or orientations.

According to the above described embodiment, a cam profile suitable for the low speed range of operation of the engine is formed upon the low speed cam 3, a cam profile suitable for the intermediate-high speed operational range of the engine is formed upon the intermediate-high speed cams 4 and 5, the intermediate-high speed rocker arms 8 and 9 are mounted in a rotatable manner respectively onto the eccentric bushings 12 and 13 of the rocker shaft 11, and the low speed rocker arm 7 is mounted directly upon the rocker shaft 11. It is therefore possible by means of the rotation of the rocker shaft 11 to select a contact mode defined either between the low speed cam 3 and the low speed rocker arm 7 or another mode occurring respectively between the intermediate-high speed cams 4 and 5 and the intermediate-high speed rocker arms 8 and 9. The intake and exhaust valves 1 and 2 may thus be selectively driven by means of the low speed cam 3 or by means of the intermediate-high speed cams 4 and 5. Therefore, it is possible to improve the output of a four-stroke cycle engine throughout a wide range extending from the low speed region to the intermediate-high speed region of the engine.

Since the selection between the low speed cam 3 and the intermediate-high speed cams 4 and 5 is preformed by means of the rotation of the rocker shaft 11 having the eccentric bushings 12 and 13 disposed thereon, a large stress does not occur within each of these portions when the selection is to be made between the cams 3, 4 and 5. Thus cams 3, 4 and 5 may be smoothly selected.

Furthermore, when the shim **14*b* is to be changed so as to adjust the tappet clearance while the cam shaft 6 remains in the assembled manner, the rocker shaft 11 is slid toward the outside of the cylinder head 21 against the biasing force of the positioning spring 31 and is then slightly rotated in the peripheral direction. Accordingly, the distal end portion of the stopper screw 36 moves within the slide groove 33 and then inside the slide hold groove 34. The rocker shaft 11 is caused to stop at such position by means of the engagement between the stopper screw and the slide hold groove 34 and is held at such slid position toward the outside of the cylinder head 21. In this state, since the low speed rocker arm 7 and the intermediate-high speed rocker arms 8 and 9 have been moved axially away from the valves 1 and 2 whereby the rocker arms 7, 8 and 9 are not positioned directly above the shim 14*b*, any one of the shims 14*b*** may readily be changed.

In this way, because the rocker shaft 11 may be held at its slid position when changing the shim **14*b*, a worker can change any shim 14*b* by using two hands. Thus such replacement work is made easier and may be performed in a shorter period of time so that the replacement work of the shim 14*b*** may be efficiently effected.

Figure 11:
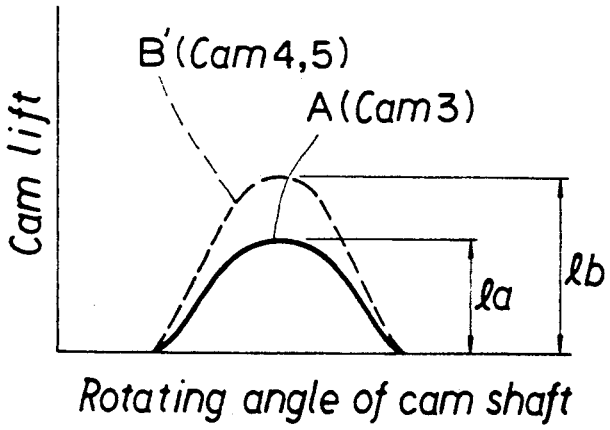
FIGS. 11 and 12 are additional diagrams showing modifications of the cam profile shown in FIG. 10.
Figure 12:
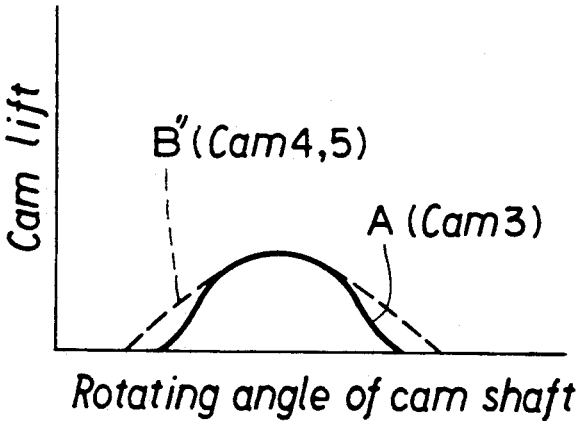

While the embodiment as above has been described with respect to a case where the cam profile of the intermediate-high speed cams 4 and 5 one as indicated by means of the broken line B in FIG. 10, the cam profile of the intermediate-high speed cams 4 and 5 may be adapted to be one as indicated by means of the broken line B′ in FIG. 11 or by means of the broken line B″ in FIG. 12 so as to change the lift characteristics of the valves 1 and 2 during the intermediate-high speed operational range of the engine.

Also, while the description of the above embodiment has been given with respect to a case where a hydraulic cylinder 15 is used as the driving source for the rotation of the rocker shaft 11, a motor may be used as the driving source of rotation where the rocker shaft 11 is driven so as to be rotated by using power transmission means such as, for example, a pulley and belt.

Since the rack 16 is connected to the piston 40 of the hydraulic cylinder 15 is engaged, from the upper side, as viewed, with the pinion 17, the hydraulic cylinder 15 and the rack 16 can be assembled with the cylinder head 21 after the rocker shaft 11, the rocker arms 7, 8, 9, the valves 1, 2 and the like are completely assembled with the cylinder head 21. Furthermore, when the cylinder 15 and the rack 16 are assembled, there is no need to slide the rocker shaft 11 against the biasing force of the positioning spring 31 and outwardly of the cylinder head 21, so that the hydraulic cylinder 15 and the rack 16 can be easily assembled. Since the tooth portions of the rack 16 are directed downwardly, the clogging of the rack 16 with cut chips can be effectively prevented. In addition, in a case where the rack 16 is engaged with the pinion 17 from the lower side, the hydraulic cylinder 15 is to be positioned within a lower portion of the cam chain chamber 26, whereas in the described embodiment, the hydraulic cylinder 15 is positioned within an upper portion of the cam chain chamber 26, a passage for the dropped head lubrication oil can therefore be insured within the cam chain chamber 26.

Figure 8B:
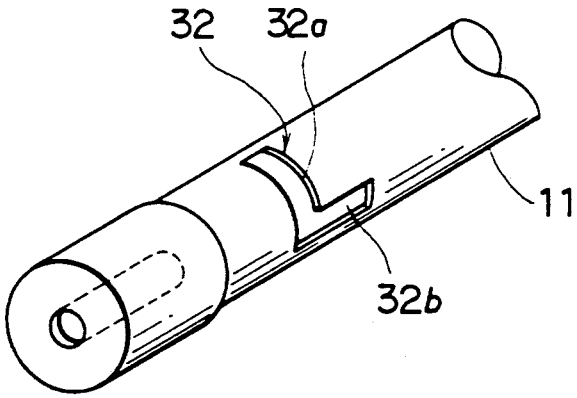

In accordance with a modification of the rocker shaft 11 as shown in FIG. 8B, the stopper groove is composed of a stopper portion **32*a* and a slide portion 32*b*. The slide portion 32*b* functions at a time when one of the shims 14*b* disposed upon the stem head of the valve 1 or 2 is to be exchanged so as to adjust the tappet clearance. Except for the fact that the slide hold groove is not provided, the structure and the operation of the examples of FIGS. 4A and 4B** are substantially the same.

In both examples, when the rocker shaft 11 is rotated by means of the associated operation of the hydraulic cylinder 15, the rack 16 and the pinion 17, the stopper screw 36 abuts against the ends of the stopper portion of the stopper groove. Accordingly, the rocker shaft 11 is stopped at either one of the rotated positions at which the thick walled portions of the eccentric bushings 12 and 13 are disposed either diagonally forwardly or diagonally rearwardly. At this time, the rotating force of the hydraulic cylinder 15 acts upon the pinion end portion of the rocker shaft and the force is transmitted to the other end of the stopper groove by means of the stopper screw. According to these rotating and reverse forces, the rocker shaft achieves a state in which torsion is applied to substantially the entire axial length of the rocker shaft. Accordingly, since the stopper groove is formed within the end portion of the rocker shaft which is opposite the end portion upon which the pinion is formed, the torsion is applied to approximately the entire axial length thereof when the engine is driven, thus ensuring a stable operation. Accordingly, even if the respective rocker arms are violently reciprocated, the rocker shaft is never swung in a similar manner, thus effectively preventing abrasion of the rocker shaft bearing portion.

As has been described, with the valve actuating mechanism for a four-stroke cycle engine according to this invention, an eccentric large-diameter portion is formed upon a rocker shaft which is supported in a rotatable manner, second and third rocker arms are mounted upon the eccentric large-diameter portion, and a first rocker arm is located between the second and the third rocker arms and is mounted directly upon the rocker shaft. It is thus possible to improve the output of the engine throughout a wide speed range by selecting the cams as described above and as a result of the rotation of the rocker shaft.

The positioning groove, the slide groove and the slide hold groove are continuously formed upon the rocker shaft, the distal end portion of a stopper screw is accommodated within these grooves and the rocker shaft may thus be held at its slid position by causing the distal end portion of the stopper screw to engage the slide hold groove when the rocker shaft is slid so as to facilitate the change of a shim for adjusting the tappet clearance, thereby facilitating the operation for changing the shim and improving the efficiency of the operation for changing the shim.

Furthermore, the driving mechanism for rotating the rocker shaft is operatively connected to one end of the rocker shaft and the stopper mechanism for positioning the rotating position of the rocker shaft is disposed at the other end of the rocker shaft, so that torsion can always be stably maintained throughout substantially the entire axial length of the rocker shaft during the operation of the engine, whereby the rocker shaft is never swung by means of the violent vertical movement of the rocker arms and the abrasion of the rocker shaft bearing portion can be effectively prevented.

In addition, the rack member connected to the hydraulic cylinder of the diving means is engaged with the pinion formed upon one end of the rocker shaft from the upper side of the cylinder head, so that the rocker shaft driving mechanism can be assembled after the rocker shaft, the rocker arms, the intake and exhaust valves and the like have been completely assembled with the cylinder head without necessarily sliding the rocker shaft, thus simplifying the assembly processes of the members and mechanisms.

It is to be noted that the present invention is not limited to the described embodiments and many other changes, modifications and combinations may be made without departing from the scope of the appended claims.

What is claimed is:

1. A valve actuating mechanism disposed within a four-stroke cycle engine in which exhaust and intake valves are disposed, comprising:

a rocker shaft rotatably supported upon a cylinder head of an engine unit and having eccentric large-diameter portions formed upon said rocker shaft;

rocker arm means including a first rocker arm rotatably mounted directly upon said rocker shaft, and scanned and third rocker arms rotatably mounted upon said eccentric large-diameter portions of said rocker shaft with said first rocker arm being interposed between said second and third rocker arms;

cam means including first, second, and third cam members, which drives said first, second, and third rocker arms, respectively, said second and third cams having the same cam profiles and said first cam having a cam profile which is different from those of said second and third cams; and a stopper mechanism for controlling a sliding position of said rocker shaft and including a stopper screw hole formed within said cylinder head, a stopper screw threadedly engaged within said stopper screw hole, and a stopper means disposed upon one end portion of said rocker shaft.

2. A valve actuating mechanism according to claim 1, wherein said stopper means is composed of a groove means formed upon an outer periphery of the one end of the rocker shaft and including a positioning groove extending in a circumferential direction thereof into which a front portion of the stopper screw is fitted for limiting a rotating position of said rocker shaft and a slide groove being formed continuously with the positioning groove and extending in an axial direction of the rocker shaft in and along which the rocker shaft is slid.

3. A valve actuating mechanism according to claim 2, wherein said groove means further comprises a slide hold groove being formed continuously with the slide groove and extending in the circumferential direction of the rocker shaft for holding the slid position thereof.

4. A valve actuating mechanism according to claim 1, wherein said first rocker arm and said first cam are located with respect to each other for a low speed operation of said engine, and said second and third rocker arms and said second and third cams are located with respect to each other for an intermediate-high speed operation of said engine.

5. A valve actuating mechanism according to claim 1, wherein said eccentric large-diameter portions are formed by eccentric bushings each having a diameter larger than the diameter of said rocker shaft, said bushings having axial centers eccentric from the axial center of said rocker shaft.

6. A valve actuating mechanism according to claim 1, wherein the first rocker arm is provided with branched distal ends and distal ends of said second and third rocker arms abut against each of the branched distal ends of said first rocker arm through means of shims.

7. A valve actuating mechanism according to claim 6, wherein said branched distal ends of said first rocker arm are operatively connected to said exhaust and intake valves disposed in the engine.

8. A valve actuating mechanism disposed within a four-stroke cycle engine in which exhaust and intake valves are disposed, comprising:

a rocker shaft rotatably supported upon a cylinder head of an engine unit and having eccentric large-diameter portions formed upon said rocker shaft;

rocker arm means including a first rocker arm rotatably mounted directly upon said rocker shaft, and second and third rocker arms rotatably mounted upon said eccentric large-diameter portions of said rocker shaft with said first rocker arm being interposed between said second and third rocker arms;

cam means, including first, second, and third cam members, which drives said first, second, and third rocker arms, respectively, said second and third cams having the same cam profiles while said first cam has a cam profile which is different from those of said second and third cams;

a drive mechanism connected to one end portion of said rocker shaft for driving said rocker shaft; and a stopper mechanism disposed upon another end of said rocker shaft for determining a rotating position of said rocker shaft.

9. A valve actuating mechanism according to claim 8, wherein said stopper mechanism includes a stopper screw hole formed within said cylinder head, a stopper screw engaged within said stopper screw hole and a stopper means disposed upon said another end portion of said rocker shaft.

10. A valve actuating mechanism according to claim 9, wherein said stopper means is composed of a groove means formed upon an outer periphery of said another end of the rocker shaft and including a positioning groove extending in a circumferential direction thereof into which a front portion of the stopper screw is fitted for limiting said rotating position of said rocker shaft and a slide groove being formed continuously with respect to the positioning groove and extending in an axial direction of the rocker shaft in and along which the rocker shaft is slid.

11. A valve actuating mechanism according to claim 10, wherein said groove means further comprises a slide hold goove being formed continuously with respect to the slide groove and extending in the circumferential direction of the rocker shaft for holding the slid position thereof.

12. A valve actuating mechanism according to claim 8, wherein said first rocker arm and said first cam are located with respect to each other for a low speed operation of said engine, and said second and third rocker arms and said second and third cams are located with respect to each other for an intermediate-high speed operation of said engine.

13. A valve actuating mechanism according to claim 8, wherein said eccentric large-diameter portions are formed by eccentric bushings each having a diameter larger than the diameter of said rocker shaft, said bushings having axial centers eccentric from the axial center of said rocker shaft.

14. A valve actuating mechanism according to claim 9, wherein the first rocker arm is provided with branched distal ends and distal ends of said second and third rocker arms abut against each of the branched distal ends of said first rocker arm through means of shims.

15. A valve actuating mechanism according to claim 14, wherein said branched distal ends of said first rocker arm are operatively connected to said exhaust and intake valves disposed in the engine.

16. A valve actuating mechanism disposed within a four-stroke cycle engine in which exhaust and intake valves are disposed, comprising:

a rocker shaft rotatably supported upon a cylinder head of an engine unit and having eccentric large-diameter portions formed upon said rocker shaft;

rocker arm means including a first rocker arm rotatably mounted directly upon said rocker shaft, and second and third rocker arms rotatably mounted upon said eccentric large-diameter portions of said rocker shaft with said first rocker arm being interposed between said second and third rocker arms;

cam means including first, second, and third cam members which drives said first, second, and third rocker arms, respectively, said second and third cams having the same cam profiles while said first cam has a cam profile which is different from those of said second and third cams; and a driving mechanism connected to one end of said rocker shaft for driving said rocker shaft, said driving mechanism including a drive means, a rack member operatively connected to said drive means, and a pinion member formed upon said one end of said rocker shaft so as to be engageable with said rack member.

17. A valve actuating mechanism according to claim 16, wherein said drive means is a hydraulic cylinder means including a piston member.

18. A valve actuating mechanism according to claim 16, wherein said rack member is engaged with said pinion from an upper side of the cylinder head.

19. A valve actuating mechanism according to claim 16 further comprising a stopper mechanism disposed upon another end of the rocker shaft for determining a rotating position of the rocker shaft, said stopper mechanism including a stopper screw hole within said cylinder head, a stopper screw engaged within the stopper screw hole, and a stopper means disposed upon said another end portion of said rocker shaft.

20. A valve actuating mechanism according to claim 19, wherein said stopper means is composed of a groove means formed upon an outer periphery of said another end of the rocker shaft and including a positioning groove extending in a circumferential direction thereof into which a front portion of the stopper screw is fitted for limiting the rotating movement of said rocker shaft and a slide groove being formed continuously with respect to the positioning groove and extending in an axial direction of the rocker shaft in and along which the rocker shaft is slid.

21. A valve actuating mechanism according to claim 20, wherein said groove means further comprises a slide hold groove being formed continuous with respect to the slide groove and extending in the circumferential direction of the rocker shaft for holding the slid position thereof.

22. A valve actuating mechanism according to claim 16, wherein said first rocker arm and said first cam are located with respect to each other for a low speed operation of said engine, and said second and third rocker arms and said second and third cams are located with respect to each other for an intermediate-high speed operation of said engine.

23. A valve actuating mechanism according to claim 16, wherein said eccentric large-diameter portions are formed by eccentric bushings each having a diameter larger than the diameter of said rocker shaft, said bushings having axial centers eccentric from the axial center of said rocker shaft.

24. A valve actuating mechanism according to claim 16, wherein the first rocker arm is provided with branched distal ends and distal ends of said second and third rocker arms abut against each of the branched distal ends of said first rocker arm through means of shims.

25. A valve actuating mechanism according to claim 24, wherein said branched distal ends of said first rocker arm are operatively connected to said exhaust and intake valves disposed in the engine.

* * * * *